US005188481A

United States Patent [19]

O'Brien

[11] Patent Number: 5,188,481

[45] Date of Patent: Feb. 23, 1993

[54] ASPHALT HEATING UNIT

[76] Inventor: William J. O'Brien, P.O. Box 143, Goshen, Mass. 01032

[21] Appl. No.: 734,363

[22] Filed: Jul. 22, 1991

[51] Int. Cl.[5] ..... E01C 23/14

[52] U.S. Cl. ..... 404/95; 404/112

[58] Field of Search ..... 404/77, 79, 95, 112

[56] References Cited

U.S. PATENT DOCUMENTS 4,557,626 12/1985 McKay et al. ..... 404/112 X

FOREIGN PATENT DOCUMENTS 2704654 8/1978 Fed. Rep. of Germany ..... 404/95

*Primary Examiner*—William P. Neuder

*Attorney, Agent, or Firm*—Cooper & Dunham

[57] ABSTRACT

A movable asphalt heating unit for heating paved asphalt for paving or repairing is provided comprising a frame, and a heating chamber mounted to the frame in a rotatable arrangement whereby the heating chamber may be selectively positioned on the right side, left side or rear of the frame. The heating chamber preferably comprises one or more infrared heating elements.

7 Claims, 2 Drawing Sheets

ASPHALT HEATING UNIT

BACKGROUND OF THE INVENTION

The present invention relates to an improved asphalt heating unit for heating existing asphalt paved surfaces, primarily in preparation for joint and seam repair.

The repair of asphalt in streets and other paved areas is a never-ending job. Asphalt becomes deteriorated and pot-holed, and utilities make cuts in the asphalt for accessing utility lines and pipes, requiring frequent repair. In such repair, new asphalt pavement is frequently laid next to old asphalt. The abutment of the old asphalt with the new asphalt creates a seam or joint which needs to be sealed, otherwise the constant flow of traffic and natural elements such as rain and ice will quickly dislodge the asphalt along the seam, creating an unacceptable crack or crevices.

One method used to perform joint and seam repair is simply to pour the new asphalt next to the old and apply joint and seam tacking fluid. However, such a procedure does not always result in a good joint, and is therefore used primarily for quick fixes where a limited lifetime of the paved area is expected. In any case, the tacking fluid is messy, and if it is not used, the new asphalt will be quickly dislodged.

Another method used to repair joint and seams is to heat the existing asphalt adjacent the new asphalt, whereby the old and new asphalt can be mixed to create a homogeneous product in the seam area.

One device used for heating the existing asphalt is an asphalt heater mounted on a trailer to extend from one side of the trailer. The trailer is pulled behind a vehicle which travels along the path of the joint, with the heater positioned over the joint to heat the edge of the old asphalt. The trailer moves at a certain speed, depending upon the BTU output of the heater and the ambient environmental temperature, so that the existing asphalt edge will be sufficiently heated to be mixed with new asphalt being poured. One such device is a Poweray model CS (90A/90/108) Infrared Asphalt Heater.

Since the heater extends only to one side of the trailer, and the trailer normally travels on the existing asphalt and not the new asphalt being poured, whenever the seam makes a 90-degree turn, such as from a longitudinal joint line which travels in the direction of traffic to a transverse joint line cutting across the flow of traffic, the vehicle and trailer must also make a 90-degree turn. The vehicle and trailer sometimes move with the direction of traffic, cut across 90-degrees transverse to the traffic, and then make another 90-degree turn to travel in a direction against the traffic. Having to navigate both a vehicle and a tractor so that the heating element is always over the joint line is usually a cumbersome operation.

SUMMARY OF THE INVENTION

It is an object of the present invention to provide an improved asphalt heating unit providing flexibility in heating joints in different areas around the trailer without having to reposition or turn the trailer.

In accordance with the present invention, a movable asphalt heating unit for use in repairing asphalt in paved areas is provided comprising a movable frame with wheels, said frame having a front, two opposite sides and a rear, and a heating chamber for generating heat for heating asphalt pavement. The unit further comprises means for mounting the heating chamber to the frame and for rotating the heating chamber to at least two positions, including a first position at which the chamber is positioned along one side of the frame, and a second position at which the chamber is positioned along another side of the frame, whereby the asphalt heating unit can heat asphalt pavements on at least two sides of the frame without having to move the frame relative to the paved area. Preferably, the heating chamber can be rotated to a third side of the frame. The means for mounting and rotating the heating chamber preferably comprises a base attached to the frame, a rotary table for holding the heating chamber along an edge of the frame, and means for rotatably attaching the table to the base, and wherein the heating chamber is mounted to the rotary table, whereby the heating chamber can be located at a first, second or third position by rotating the table relative to the base.

Other objects and advantages of the present invention will become apparent in view of the following detailed description, accompanying claims and attached drawings.

DETAILED DESCRIPTION OF THE PREFERRED EMBODIMENT

Figure 1:
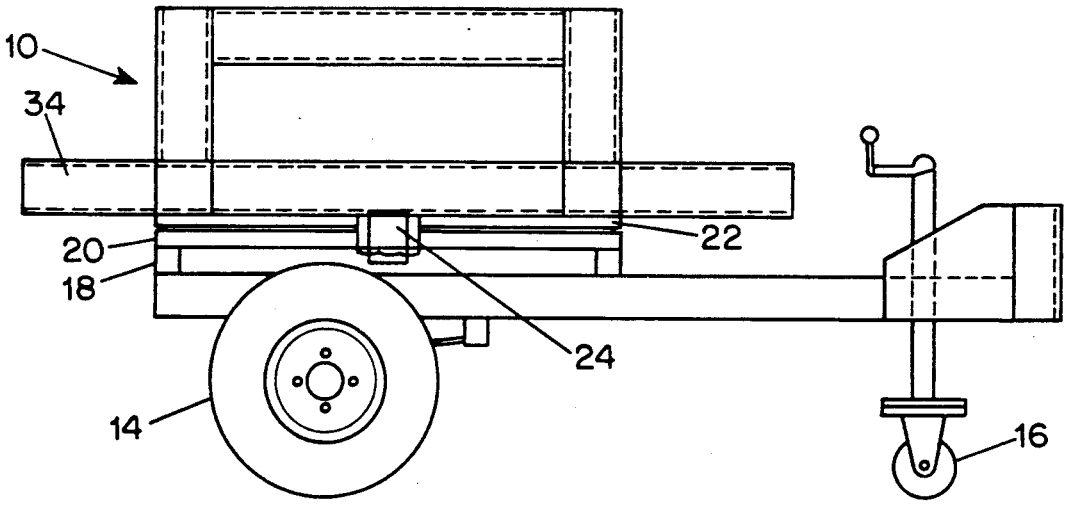
FIG. 1 is a side elevational view of an asphalt heating unit according to the present invention, with the heating chamber not shown.

FIG. 1 shows a movable asphalt heating unit 100 according to the present invention. The unit comprises a lower frame 12 arranged in a trailer configuration, having two rear wheels 14 and a jack and castor wheel 16 in the front. The frame has two opposing sides 15, 17 and a rear end or third side 19. Attached to the frame 12 is a riser 18 to clear the rear wheel fenders and on top of the riser is mounted a plate 20 which is welded to the riser and supporting frame.

A rotary table 22 having the same side-to-side and front-to-rear dimension as the plate 20 is provided on top of the plate and rotationally mounted to it by means of a shaft 24, positioned within a boss 25. The rotary table can rotate with respect to the underlying frame 12 of the trailer, as the shaft is rotatable within the boss.

Figure 2:
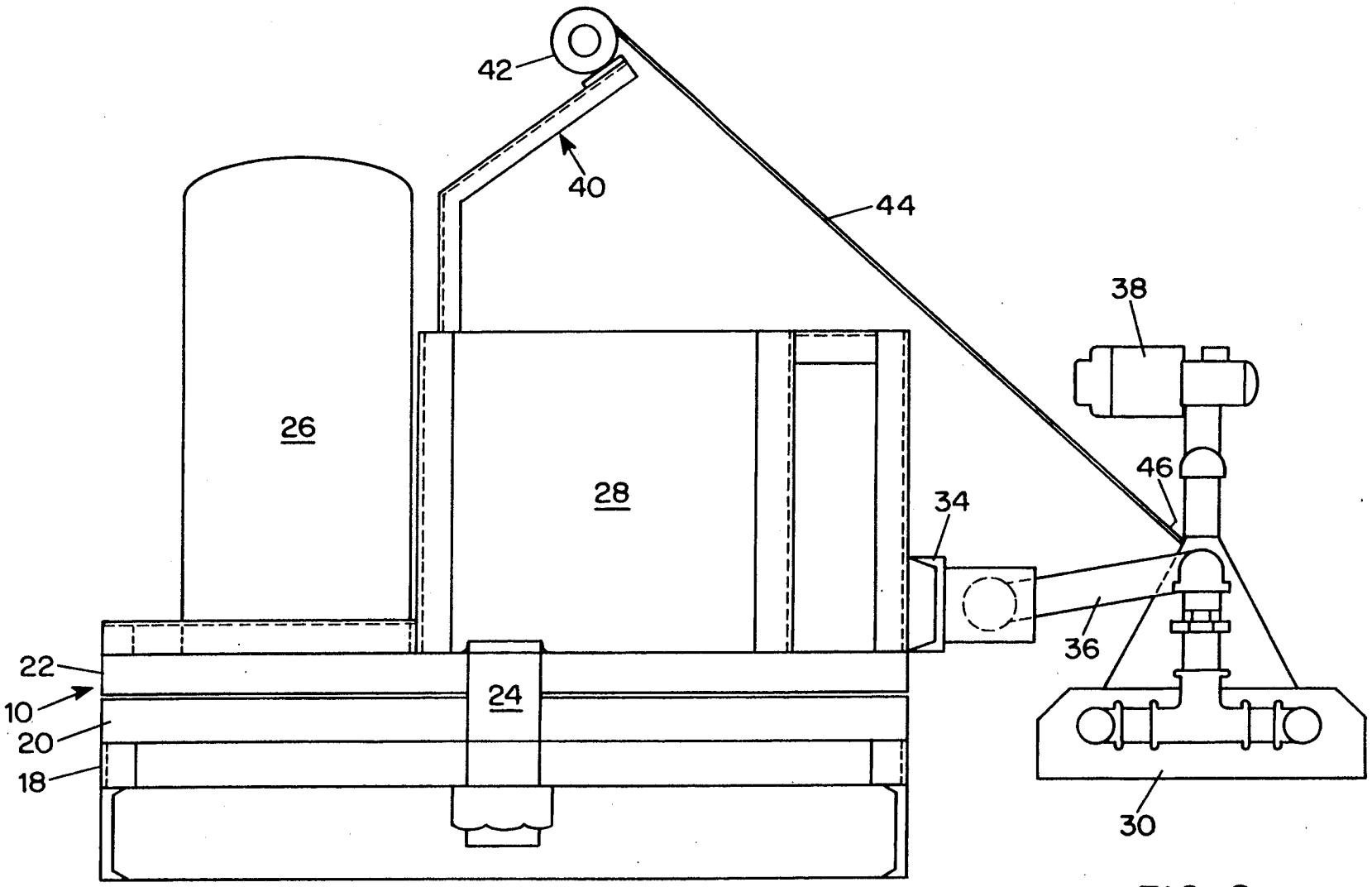
FIG. 2 a side elevational view of the asphalt heating unit according to the invention, but with the bottom trailer portion not shown.

As shown in FIG. 2, on the rotary table 22 is disposed at least one propane tank 26, a battery box 28, and a heating chamber assembly 30. The heating chamber assembly is pivotally mounted to a longitudinally mounted channel member 34 having pivoting side extending arms 36 so that the heating chamber can pivot from a horizontal position as shown to a vertical position. In the horizontal position, the heating chamber is disposed substantially parallel to the pavement, and extends outwardly from the side of the trailer, but in the vertical position the heating chamber is lifted close to the side of the frame, with minimum overhang, thereby reducing the width of the trailer.

The heating chamber preferably comprises "Inconel" infrared heating elements 31. The heating chamber includes a blower 38 for mixing air and propane gas and supplying the mixture to the infrared heater through burners 39 which heat the elements 31. Preferably, more than one heating element is provided.

A boom mechanism 40 with an associated winch (or motor and reel) 42 controls the length of extension of a cable 44, the free end 46 of which is attached to the top of the heating chamber. By appropriate control of the motor and the boom assembly, the heating chamber can be positioned in the horizontal position, vertical position or any position in-between. Of course, when in the horizontal position, the heating chamber is disposed to heat pavement directly beneath it, and when in the vertical position, the device may be transported or stored.

Figure 3:
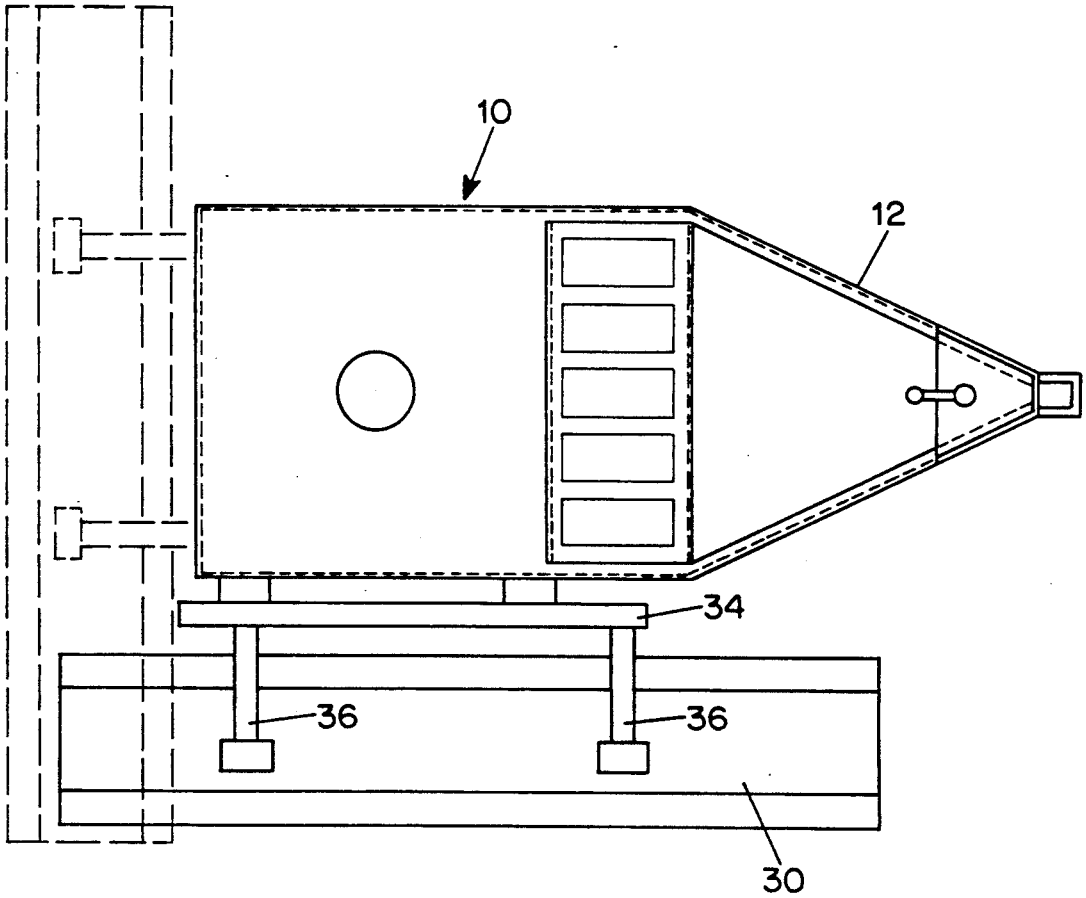
FIG. 3 is a top plan view of the asphalt heating unit according to the present invention, showing the heating chamber to the right side of the unit in solid lines, and to the rear of the unit in dashed lines.

As illustrated in FIG. 3, due to the rotatably mounted rotary table, the heating chamber can be positioned on the right side of the frame (as shown in solid lines) or can be positioned on the rear end of the trailer frame (as shown in dashed lines). The heating chamber can also be located on the left side of the frame. In this manner, longitudinal joints which are disposed on either the right side or the left side of the trailer can be heated with the asphalt heating unit according to the invention, as well as joints which are transverse or parallel to the rear of the asphalt heating unit While one preferred embodiment has been shown and described, it will be apparent to those skilled in the art that numerous variations and modifications may be effected without departing from the true spirit and scope of the novel concept of the invention. Accordingly, the invention is not limited to the preferred embodiment illustrated and described, but is to be limited only by way of the appended claims.

What is claimed is:

1. A movable asphalt heating unit for use in heating asphalt, comprising:

a movable frame with wheels, said frame having a front, two opposite sides and a rear;

a heating chamber for generating heat for heating asphalt pavement; and means for holding said heating chamber on said frame and for rotating said heating chamber to at least two positions, including a first position at which the chamber is positioned entirely along one side of the frame, and a second position at which the chamber is positioned entirely along the other side of the frame, whereby the asphalt heating unit can heat asphalt pavement on at least two sides of the frame.

2. The asphalt heating unit according to claim 1, wherein the means for mounting and rotating the heating chamber comprises means for mounting and rotating the heating chamber to a third position along a third side of the frame.

3. The asphalt heating unit according to claim 1, wherein the means for mounting and rotating said heating chamber comprises a base attached to said frame, a rotary table for holding said heating chamber alongside an edge of the table, and means for rotatably attaching said table to said base, and wherein said heating chamber is mounted to said rotary table, whereby said heating chamber can be located at the first or second position by rotating said table relative to said base.

4. The asphalt heating unit according to claim 1, wherein the movable frame is a trailer.

5. The asphalt heating unit according to claim 1, wherein the heating chamber comprises an infrared heater.

6. The asphalt heating unit according to claim 3, wherein the means for pivotally attaching said table to said base comprises a shaft mounted in a boss in said rotary table and frame base.

7. The asphalt heating unit according to claim 1, wherein the means for mounting and rotating said heating chamber comprises means for pivotally mounting said heating chamber, wherein said chamber is adapted to move from a substantially horizontal position extending outwards from said frame, to a substantially vertical position adjacent a side of said frame.

* * * * *